US005967561A

United States Patent [19]

Glenn

[11] Patent Number: 5,967,561

[45] Date of Patent: Oct. 19, 1999

[54] COMPUTER DISK LABEL

[76] Inventor: Joel Glenn, 1801 Spring Ridge Dr., Arlington Heights, Ill. 60004

[21] Appl. No.: 09/078,888

[22] Filed: May 14, 1998

[51] Int. Cl.[6] ..... B42D 15/00

[52] U.S. Cl. ..... 283/81; 40/359; 283/36; 283/79

[58] Field of Search ..... 283/36–42, 79, 283/81; 40/359

[56] References Cited

U.S. PATENT DOCUMENTS

| | | | |
|---|---|---|---|
| 5,119,933 | 6/1992 | Taylor | 206/232 |
| 5,209,353 | 5/1993 | Lehtovaara | 206/459.5 |
| 5,413,215 | 5/1995 | Hardinger, Jr. | 206/308.1 |
| 5,449,066 | 9/1995 | Caine | 206/232 |
| 5,480,024 | 1/1996 | Hertema | 206/232 |

*Primary Examiner*—Andrea L. Pitts
*Assistant Examiner*—Monica Smith
*Attorney, Agent, or Firm*—Rudnick & Wolfe

[57] ABSTRACT

The computer disk label that forms the basis for the present invention comprises a sheet of flexible material including three portions. The first portion at one edge of the sheet has sections that are selectively removed or retained to form a first side of a tab. The second adjacent portion has sections that fold over the outer edge of a disk and adhere to one side of the disk if aligned with the removed sections of the first portions. Otherwise, sections of the second portion extend from the outer edge of the disk to form a side of the tab if aligned with retained sections of the first portion. The third portion of the sheet is disposed to engage and adhere to the opposite side of the disk from the folded sections of the second portion. The first side of the tab is folded down to contact and adhere to the second side of the tab thereby forming a tab that extends out from the outer edge of the disk. The tab protruding from the edge of the disk allows the indicia on the disk to be easily read even when it is in a disk drive or in a storage box.

8 Claims, 2 Drawing Sheets

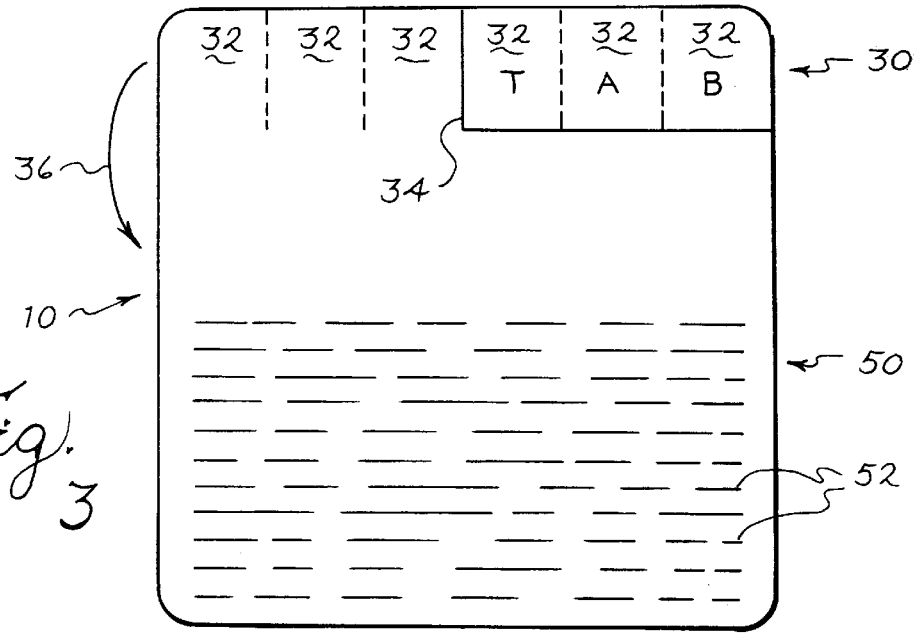
Fig. 3
Fig. 4
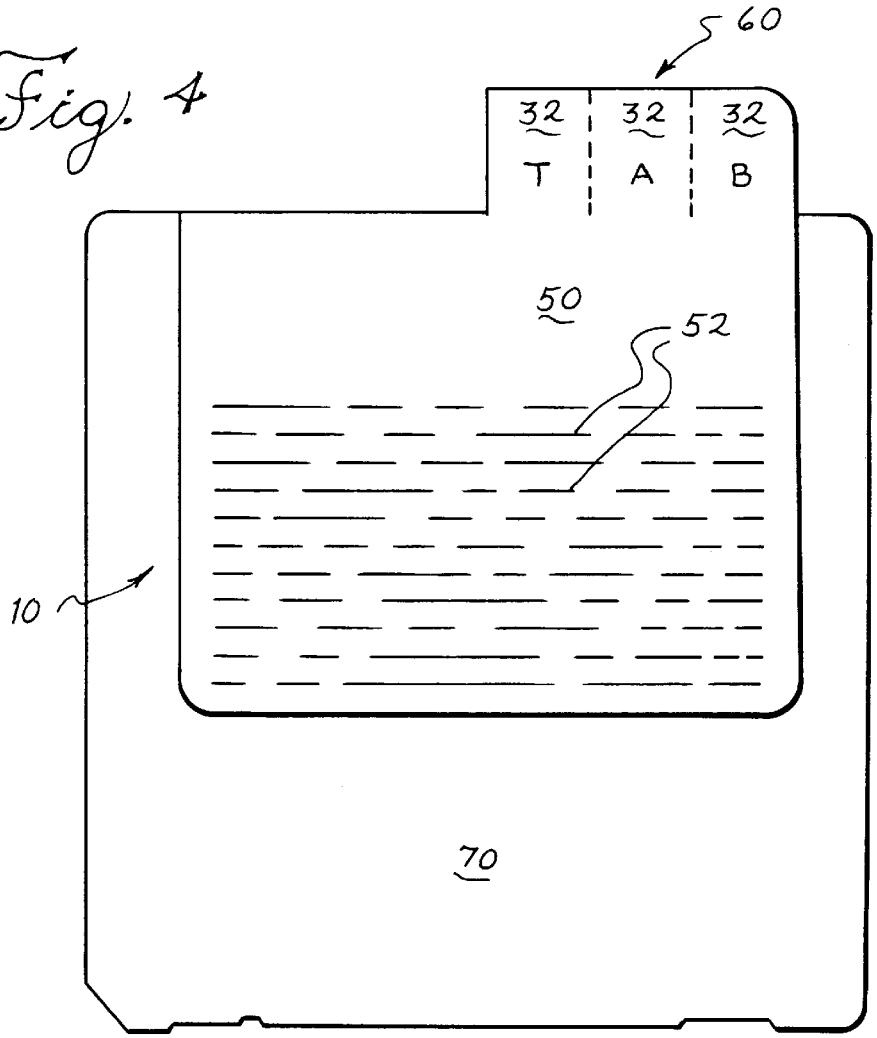

COMPUTER DISK LABEL

BACKGROUND OF THE INVENTION

1. Field of the Invention

The present invention relates to the field of computer accessories, and more particularly to a computer disk label.

2. Description of Related Art

As can be seen by reference to the following U.S. Pat. Nos. 5,119,933; 5,209,353; 5,413,215; 5,449,066; and 5,480,024, the prior art is replete with myriad and diverse computer disk identification devices.

While all of the aforementioned prior art constructions are more than adequate for the basic purpose and function for which they have been specifically designed, they are uniformly deficient with respect to their failure to provide a simple, efficient, and practical system for readily identifying a computer disk and in recognizing the presence of a computer disk while it is in a disk drive or storage box.

As a consequence of the foregoing situation, there has existed a longstanding need for a new and improved computer disk label and the provision of such a construction is a stated objective of the present invention.

BRIEF SUMMARY OF THE INVENTION

Briefly stated, the computer disk label that forms the basis for the present invention comprises a sheet of flexible material including three portions. The first portion at one edge of the sheet has sections that are selectively removed or retained to form a first side of a tab. The second adjacent portion has sections that fold over the outer edge of a disk and adhere to one side of the disk if aligned with the removed sections of the first portions. Otherwise, sections of the second portion extend from the outer edge of the disk to form a side of the tab if aligned with retained sections of the first portion. The third portion of the sheet is disposed to engage and adhere to the opposite side of the disk from the folded sections of the second portion. The first side of the tab is folded down to contact and adhere to the second side of the tab thereby forming a tab that extends out from the outer edge of the disk. The tab protruding from the edge of the disk allows the indicia on the disk to be easily read even when it is in a disk drive or in a storage box.

In addition, the tab may be preprinted with information or left blank for the user to write on. The label is constructed with perforated sections to allow the user to form a tab at one of several positions along the edge of the disk, or to form a tab of any of a number of selected widths.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 3 is a top plan view similar to FIG. 2, but showing the retained tab forming sections of the first portion folded back out of view opposite the tab forming sections of the second portion; and FIG. 4 is a top plan view similar to FIG. 3, but showing the label attached to a computer disk with sections of the second portion folded back out of view to contact and adhere to the opposite side of the disk, and showing the formed tab extending out from the edge of the disk.

DETAILED DESCRIPTION OF THE INVENTION

Figure 1:
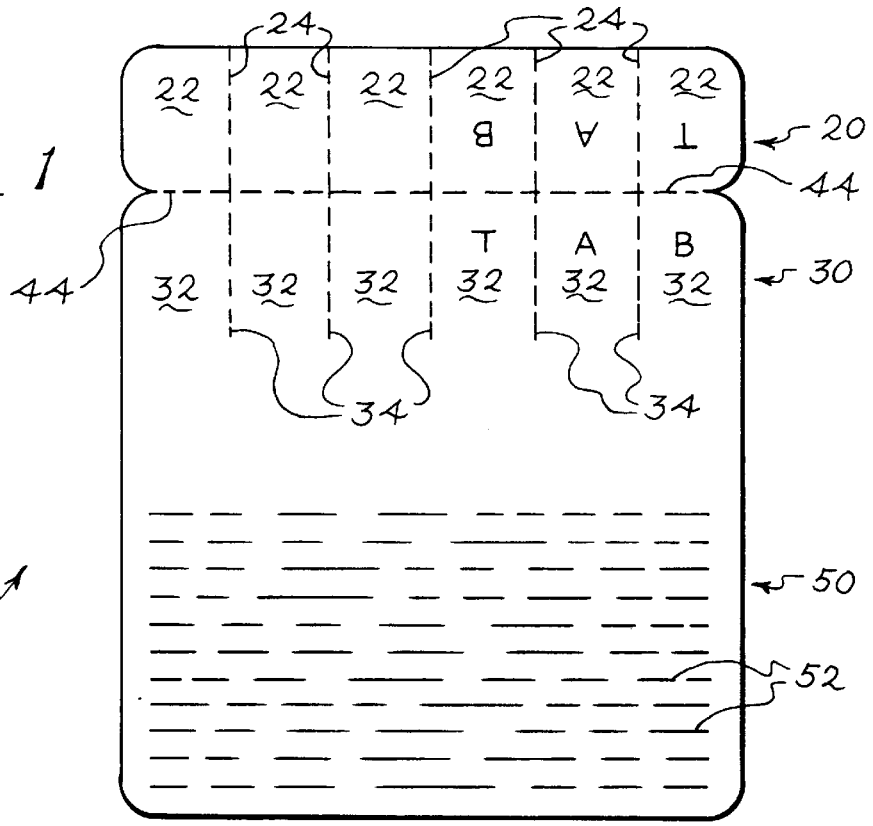
FIG. 1 is a top plan view of the computer disk label of the present invention showing perforated sections of a first portion at one edge of the label, and perforated sections of a second portion inward and adjacent to the first portion.

As can be seen by reference to the drawings, and in particularly to FIG. 1, the computer disk label that forms the basis of the present invention is designated generally by the reference number 10. The label 10 is formed of a sheet of flexible material of suitable construction for labels that are durable under high usage conditions. Preferred materials included durable plastic backed or reinforced materials that will accept printing or writing. The material should also allow for easy and uniform tearing along perforated lines. Various backing layers may be used to adhere to the back of the label so long as the backing layer easily releases from the adhesive on the label back and easily tears at perforations.

The label 10 includes a first portion 20 located at one edge of the sheet extending across the width of the label 10. The first portion 20 is divided into sections 22 separated by perforated lines 24. A second portion 30 is located inward from the first portion 20 and is also divided into sections 32 that are separated by perforated lines 34. Perforated line 44 defines the boundary of the first and second portions 20 and 30. The perforated lines 24 and 34 are aligned so that adjacent sections 22 and 32 are of equal width. Also, the sections 22 of the first portion 20 are substantially uniform in width, and the sections 32 are likewise uniform in width. Indicia such as the term "TAB" may be printed or written on adjacent sections 22 and 32 to provide information to the user. Because the sections 22 will extend distally from the rest of the label 10, the sections 22 may also be used to visibly indicate the presence of a disk or diskette in a disk drive or a storage container. A third portion 50 carries a series of lines 52 where additional detailed information can be entered.

Figure 2:
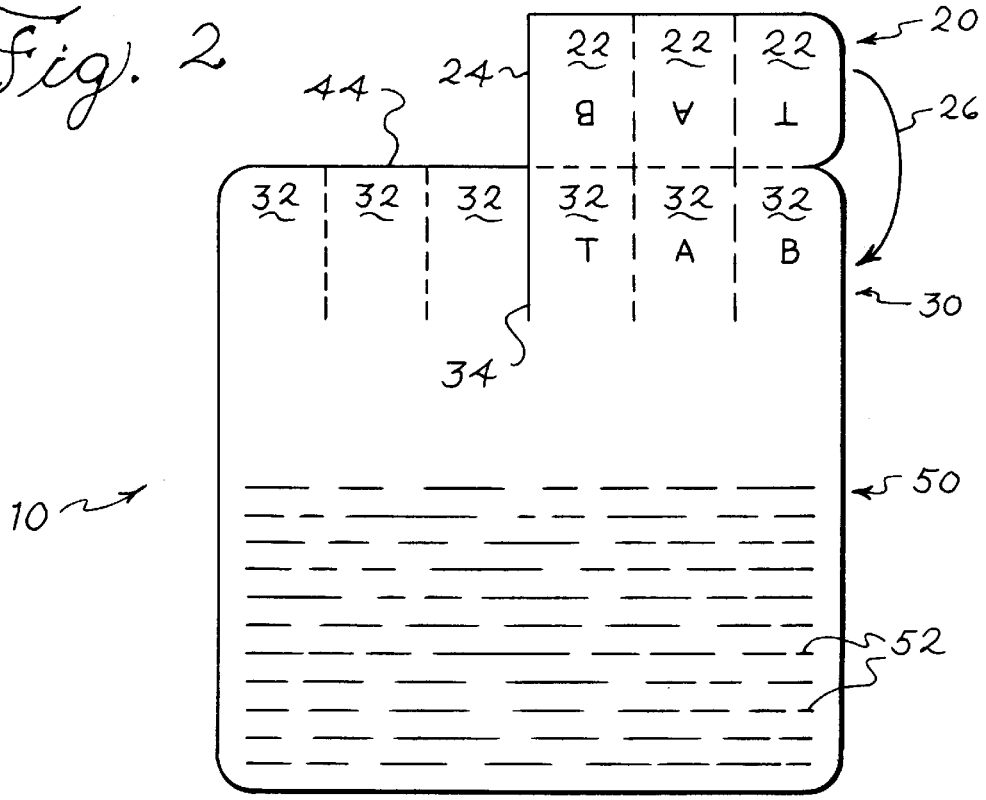
FIG. 2 is a top plan view similar to FIG. 1, but showing sections of the first portion removed while the tab forming sections remain.

Once the user has selected the location of the tab along the edge, and the width of the tab desired, they can tear along perforations 24, 34 and 44 as illustrated in FIG. 2. The separated sections 22 are the discarded. The backing from the tab sections 22 and 32 shown in the upper right hand corner of FIG. 2 is then removed and the tab sections 22 are folded down as indicated by the directional arrow 26. When the back of the tab sections 22 contacts the back of tab sections 32, the completed tab 60 is formed as shown in FIGS. 3 and 4.

Still referring to FIGS. 3 and 4, the sections 32 that do not form the tab 60 are folded down as indicated by the directional arrow 36 to adhere to the back side of the disk 70. After the remaining backing is removed, the third portion 50 of the label 10 is adhered to the front of the disk 70. The tab 60 extends out from the edge of the disk 70 so that the indicia on the tab 70 may be easily read by the user even when the disk 70 is inserted into a disk drive or is located in a storage container.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A label for a computer disk storage device, the disk having a protective casing being configured for insertion into and removal from a disk drive of a data processing system, the label comprising:

a sheet of flexible material, the sheet including a first portion disposed along one edge of the sheet, a second portion disposed inward from and adjacent to the first portion, and a third portion disposed inward from and forming an adjacent boundary with the second portion, the adjacent boundary being disposed near an outer edge of the casing when the label is applied thereto, the third portion being disposed to engage and adhere to a first side of the casing;

the first portion including a number of sections selectively disposed to be removed and discarded or retained as a first tab forming side;

the second portion including a number of sections aligned with the sections of the first portion, the sections of the second portion being selectively disposed to be folded over the outer edge of the casing to engage and adhere to a second side of the casing when aligned with sections removed from the first portion or disposed to be left unfolded to extend from the outer edge as a second tab forming side when aligned with sections retained as the first tab forming side; and wherein the first tab forming side is disposed to be folded back to engage and adhere to the second tab forming side to form a tab disposed to extend out from the outer edge of the casing, whereby the tab is observed when the disk is inserted into the disk drive.

2. The label of claim 1 wherein the flexible material forming the sheet is a durable plastic that accepts printing or writing.

3. The label of claim 1 wherein the flexible material forming the sheet is reinforced and accepts printing or writing.

4. The label of claim 1 wherein perforations define a boundary between the first portion and the second portion of the sheet.

5. The label of claim 4 wherein perforations define sides of the aligned sections of the first portion and second portion of the sheet.

6. The label of claim 1 wherein the sheet includes a backing layer releasably bonded thereto.

7. The label of claim 1 wherein the sections of the first portion are substantially uniform in width.

8. The label of claim 7 wherein the sections of the second portion are substantially uniform in width.

* * * * *